US005645007A

United States Patent [19]

Benton

[11] Patent Number: 5,645,007

[45] Date of Patent: Jul. 8, 1997

[54] PERSONAL WATERCRAFT MOORING AND TRANSPORTATION SYSTEM

[75] Inventor: Mark Benton, Lake Havasu City, Ariz.

[73] Assignee: Ski Deck, LLC, Las Vegas, Nev.

[21] Appl. No.: 616,373

[22] Filed: Mar. 15, 1996

[51] Int. Cl.[6] ..... B63B 35/44

[52] U.S. Cl. ..... 114/263; 114/248

[58] Field of Search ..... 114/242, 248, 114/249, 258, 259, 260, 263, 270

[56] References Cited

U.S. PATENT DOCUMENTS

| | | | |
|---|---|---|---|
| 3,019,755 | 2/1962 | Diamond . | |
| 3,347,201 | 10/1967 | Szabo | 114/248 |
| 3,659,546 | 5/1972 | Miklos | 114/248 |
| 3,858,541 | 1/1975 | Metcalf, Jr. et al. | 114/248 |
| 3,962,983 | 6/1976 | Ono | 114/248 |
| 4,142,477 | 3/1979 | Powers | 114/263 |
| 5,353,730 | 10/1994 | Talbot | 114/248 |
| 5,372,083 | 12/1994 | Hattori | 114/248 |

*Primary Examiner*—Jesus D. Sotelo
*Attorney, Agent, or Firm*—Quirk & Tratos

[57] ABSTRACT

A personal watercraft mooring system is set forth which includes a vessel, such as a pontoon boat, houseboat or deck boat and a mooring at the vessel's stern adapted to berth at least one personal watercraft. According to one embodiment, the mooring can also be displaced to reduce drag imposed by it on the system. In another embodiment, the mooring can be raised from the water to stow the watercraft.

23 Claims, 7 Drawing Sheets

10
20
26
84
30
38
38
90
90
44
44
94
34
34
39
39
28
32
36
88
88

PERSONAL WATERCRAFT MOORING AND TRANSPORTATION SYSTEM

FIELD OF THE INVENTION

The present invention relates to moorings for personal watercraft and more particularly relates to transportable moorings for personal watercraft.

BACKGROUND OF THE INVENTION

Personal watercraft, known generically, as JETSKIS, a registered trademark of Kawasaki, Corporation. WAVERUNNERS, a registered trademark of Yamaha, Corporation and the like, have gained substantial popularity in the United States over the past two decades. Typically, these personal watercraft are small, accommodating only one person or, for larger models, three to four persons. Also, typically, these personal watercraft have impeller driven waterjet drives powered by gasoline engines.

Because these personal watercraft are small, and hence can not carry a large fuel supply, they have limited range. Further, in those models where the operator controls the personal watercraft from a standing position, operating the personal watercraft for extended periods of time, can be tiring.

Owners of personal watercraft, and to enjoy the recreation provided thereby, may also own a larger vessel of the type referred to as houseboats, pontoon boats, or platform boats. A houseboat has a hull or floats supporting a deck upon which are living quarters. A houseboat has a powerplant, which may be one or more outboard or inboard/outboard motors, to propel the vessel. Generally houseboats are characterized as slow crafts, particularly adapted to travel at limited speed, to a desired destination and anchor for extended periods of time for recreational purposes.

Pontoon boats, as the name implies, includes two or more pontoons which buoyantly support a deck and living quarters above the water. The pontoon boat may be propelled by one or more inboard or outboard motors at speeds exceeding those obtainable by a houseboat. Typically, the pontoons are configured to have an efficiently contoured bow to enable the pontoon boat to be propelled at speeds at or above thirty miles per hour.

A deck boat, contrarily to a houseboat or pontoon boat, has a typical boat profile including a hull, which may be a single, bi-hull or tri-hull configuration, powerplant and deck. Frequently the powerplant is an inboard/outboard engine which enables the deck boat to be propelled at speeds exceeding those obtainable by a pontoon boat. The hull, which may be fiberglass sandwiching a buoyant material, is adapted to present a deck at the boat's transom proximate the surface of the water. Deck boats are particularly adapted to tow and accommodate waterskiers.

Each of the houseboats, pontoon boats, and deck boats herein described, because of their size, accoutrements and ability to carry a large fuel supply, are adapted to be operated at extended ranges and for extended periods of time. These recreational vessels may, therefore, be piloted from a marina to a remote bay or lagoon to provide a platform for recreational activities, such as, waterskiing, swimming, fishing, and the like over an extended period of time.

As stated above, often those owning a houseboat, pontoon boat, or deck boat will also own one or more personal watercraft. It can therefore be appreciated that it would be desirable to be able to travel the great distances or to operate for the extended periods of time provided by these vessels to a remote location, anchor, and at that location, use the personal watercraft. Because of the personal watercraft's limited range, it may not be possible, without intermittent re-fueling, to pilot the personal watercraft under it's own power to the desired remote location. Furthermore, as described above, operation of the personal watercraft for the extended time necessary to reach the remote location, may result in discomfort to the operator.

Prior devices and methods for transporting one or more personal watercraft via a larger vessel have proven unsatisfactory. One method known, is to provide a davit on the vessel deck to hoist each of the personal watercraft from the water onto the deck for transportation by the vessel. These davits are expensive and may require retrofitting of the vessel to provide support therefor. Further, placing the personal watercraft, each of which may weigh several hundred pounds, on the vessel's deck, may cause the vessel to list or pitch effecting the hull and power plant profiles presented at the water. The alteration of the profile presented can rob the vessel of speed, maneuverability and range. Still a further drawback for this system is that, the hoisting of several hundred pounds, via the davit, can create safety risks and typically requires several persons to hoist and guide the transfer of the personal watercraft between the vessel's deck and the water. Still further, the location of the personal watercraft on the deck occupies what otherwise would be useable space affecting the comfort of the vessel's passengers during the voyage to the desired location.

Towing the personal watercraft behind the vessel is also unsatisfactory in that certain personal watercraft are, when not under power, unstable. These craft would keel over under tow, swamping the craft and its engine compartment. For those craft which are not unstable, towing presents problems relating to maneuvering in that the towed craft may collide with the vessel. Towing more than one craft also presents a problem of the craft colliding with each other. Further, at higher speeds, towed craft may become swamped in the wash of the vessel. Still further, when the craft are towed, they remain completely in the water for the duration of the operation of the vessel, which for an extended recreational voyage, may be a week or more. This tends to accelerate corrosion and the build-up of deposits from the water, chemical and biological, on the hull and other submerged components of the craft which affect performance, maintenance and the service life of the craft.

SUMMARY OF THE INVENTION

There is, therefore, a need for a personal watercraft and vessel system which provides for the transport of one or more personal watercraft by a vessel such as, a houseboat, pontoon boat, or deck boat, which is relatively inexpensive, which does not adversely effect the performance of the vessel and otherwise overcomes the problems heretofore encountered by recreational vessel owners in transporting personal watercraft.

Accordingly, there is provided, according to the present invention, a vessel and personal watercraft system which includes a vessel having a powerplant for driving the vessel in the water. The vessel may be a houseboat, pontoon boat, deck boat or similar vessel. The system further includes one or more personal watercraft such as, a jet ski, waverunner, or other similar type of personal, recreational watercraft. To provide the features and advantages herein described, a mooring is defined at the transom of the vessel to receive and moor at least one personal watercraft for transportation by the vessel. The mooring includes at least one receptacle proximate the water's surface to slidable nest the personal watercraft from the water's surface into a moored position. The receptacle has a configuration to receive the personal watercraft and define a support surface to support the personal watercraft at least partially out of the water for transportation with the vessel under power of the vessel's powerplant. Means are provided to secure the personal watercraft in the moored position for transportation by the vessel.

For a houseboat or pontoon boat, the mooring is attached at the stern of the vessel and includes a hull structure to buoyantly support the mooring, at least the one receptacle defined on the hull structure to slidable nest the personal watercraft from the water's surface into the moored position and a coupling to secure the mooring to the vessel. For vessels such as a pontoon boat, where higher speeds may be obtained, the hull structure may be of a bihull design including first and second hulls segments having substantially parallel keels, and a downwardly open duct defined between the first and second hull segments adapted to direct the vessel's powerplant wash and water displaced by the first and second hull segments during transportation in a direction aft of the mooring. The mooring, including the duct, has been found to advantageously assist the performance of this type of vessel. The mooring, according to the system, may also include means for tilting the mooring hull structure relative to the surface of the water to urge the mooring to a position to minimize drag.

Where the vessel is a deck boat, the mooring is defined at the deck boat's transom to include at least one of the aforesaid receptacles to receive the personal watercraft at least partially out of the water for transportation by the vessel.

The vessel and personal watercraft system, according to the present invention, overcome some problems noted above. For transportation to a remote location, the personal watercraft is received in a sliding relationship into the receptacle with the mooring supporting a least a portion of the personal watercraft out of the water. In this position, the personal watercraft is tied or otherwise secured to the mooring. Operation of the vessel under power of its powerplant and fuel from its fuel supply, serves to transport the personal watercraft along with the vessel to the desired remote location. At the desired location, the personal watercraft can be untied and urged from its receptacle into the water for operation. When it is desired to move the vessel, the personal watercraft is slidable nested back into its receptacle and tied for transportation with the vessel.

For particularly the higher speed pontoon boat, the attached mooring, according to the system of the present invention, includes means for changing the angle attack of the mooring relative to the water surface, so that the mooring can act to minimize drag imposed on the pontoon boat. Accordingly, despite the additional drag and weight imposed by the mooring and its contained personal watercraft, by changing the attitude of the mooring, the pontoons of the pontoon boat and its powerplant can be urged into an efficient profile with the water for higher speed operation. Further, the duct defined in the mooring has been found to assist in the maneuvering and stability of the pontoon boat.

Still further, the personal watercraft are supported at least partially out of the water avoiding the affects of corrosion and hull build-up.

BRIEF DESCRIPTION OF THE DRAWINGS

These and other features and advantages will become appreciated as the same becomes better understood with reference to the specification, claims and drawings wherein:

DETAILED DESCRIPTION OF THE PREFERRED EMBODIMENT

Figure 1:
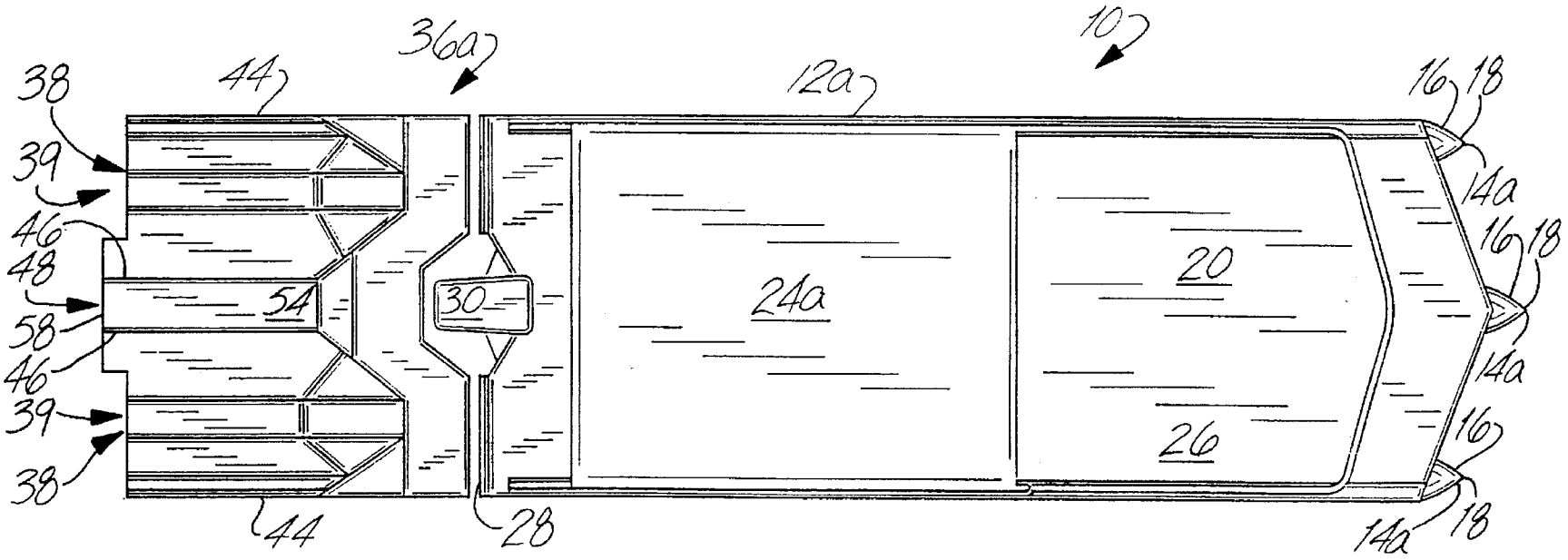
FIG. 1 is a top view of one embodiment of the system according to the present invention, including a pontoon boat.
Figure 2:
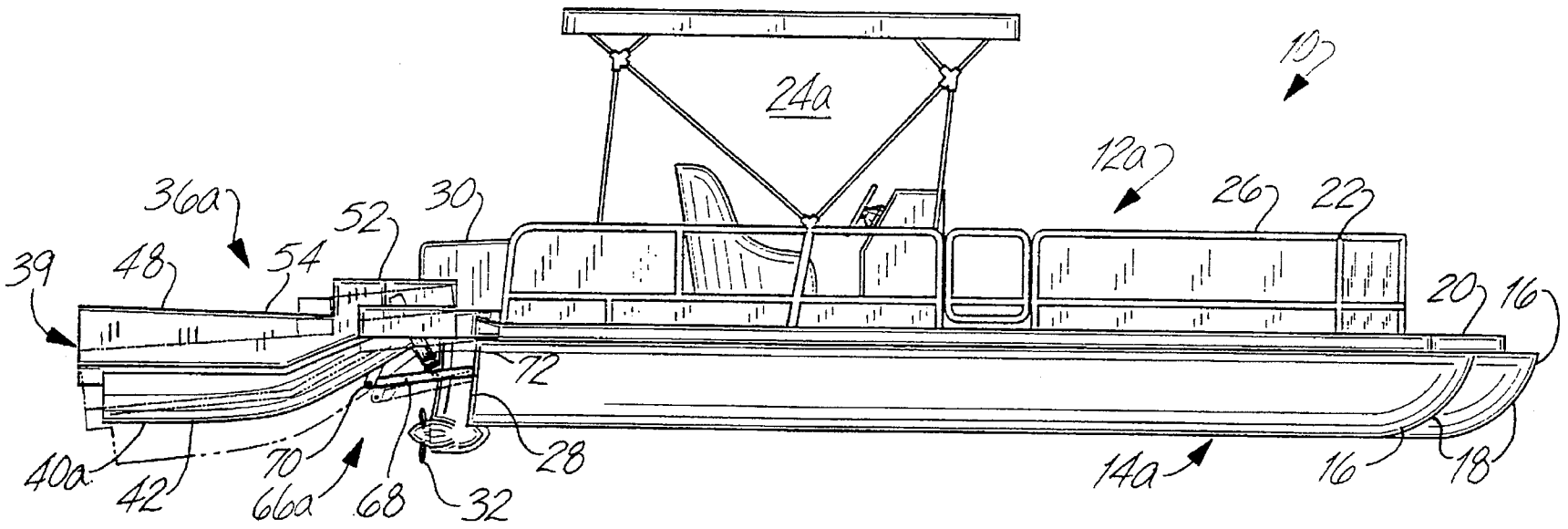
FIG. 2 is a side view of the system of FIG. 1.

Turning to the drawings, FIGS. 1 and 2 show one embodiment of a vessel and personal watercraft system 10 according to the present invention. According to this embodiment, the system 10 includes a vessel 12*a*, illustrated in FIGS. 1 and 2, as a pontoon boat. The vessel 12*a* has a hull 14*a*, defined by a plurality of appropriately configured pontoons 16. While three pontoons 16 are shown in FIG. 1, it is to be understood that any number of pontoons 16 may be used. The pontoons 16 are arranged in a parallel fashion, each having an appropriately configured bow 18 adapted to efficiently cut through the water.

The pontoons 16 support a deck 20 above the surface of the water in a known fashion. The deck 20 defines, generally, the living space for the vessel 12 and, as illustrated, supports a railing 22, cabin 24*a*, a foredeck 26 forward of the cabin 24*a* and, at the stern of the vessel 12, a transom 28. As illustrated in the drawings, the deck provides a platform for a powerplant for the vessel 12*a* to propel it through the water at speeds which may be, for a pontoon vessel 12*a*, thirty to forty miles per hour. According to FIGS. 1 and 2, this powerplant is shown as an outboard motor 30 mounted at the transom 28, the outboard motor 30 having its driving propeller 32 disposed in the water. The outboard motor 30 is controlled in a suitable and known fashion to maneuver the vessel 12*a* in both the forward and reverse directions. While the powerplant for the vessel 12*a* is shown as an outboard motor 30, it is to be understood that the powerplant for the vessel 12*a* could be an inboard-outboard motor of the type illustrated below. It is to be further understood that the vessel according to this and the other embodiments described herein can have various accoutrements at the deck 20 such as an enclosed cabin 24*a*, seating areas and the like.

The pontoon boat vessel 12*a* as described above, and for transportation of at least one personal watercraft illustrated as 34 (FIG. 4), according to prior known techniques, used a davit or crane (not shown) to hoist the personal watercraft 34 between the water and the foredeck 26. As can be appreciated, the additional weight of one or more personal watercraft 34, which are several hundreds pounds each, can alter the presentation of the pontoons 16 in the water and adversely affect the performance and maneuverability of the vessel 12*a*. The lading, represented by the placement of the personal watercraft 34 on the foredeck 26, would cause the vessel 12*a* to pitch forward or roll changing the hydraulic surface disposed in the water by the pontoons 16, as well as the positioning of the propeller 32 in the water. These factors can combine to adversely affect performance of the vessel 12*a*.

As can further be appreciated, placement of a suitable davit requires adequate structural support on the vessel to accommodate the davit as well as the allocation of deck space not only for the davit but for the watercraft 34.

The system 10, according to the present invention, overcomes these and other problems and includes a mooring 36*a*, having at least one receptacle 38. Each receptacle 38, shown as two in the drawings, has at its aft terminus an opening 39 presented at the water's surface to slidable receive and nest the personal watercraft 34 therein. The mooring 36*a*, according to this embodiment of the present invention, includes its own hull structure 40*a*, connected to the stern of the vessel 12 as hereinafter described. The hull structure 40*a*, shown as being a bi-hull, includes two hull segments 42 which, in cooperation with sides 44 and spaced, upstanding walls 46 of a downwardly open duct 48, define the pair of receptacles 38 to receive, and at least partially, support the personal watercraft 34. While, as illustrated in FIGS. 1–3, the mooring 36*a* is shown as adapted to receive two personal watercraft 34, is to be understood that the mooring 36*a* could receive one, three, or any other suitable number of personal watercraft 34.

The mooring 36*a*, including its hull structure 40*a*, sides 44 and remaining construction, can be formed from fiberglass, aluminum, or any other suitable material. Preferably, the mooring 36*a* is a sandwich-type of fiberglass construction, which sandwiches buoyant material such as styrofoam or the like to make the mooring 36*a* sufficiently buoyant to support the lading offered by the watercraft 34.

Figure 3:
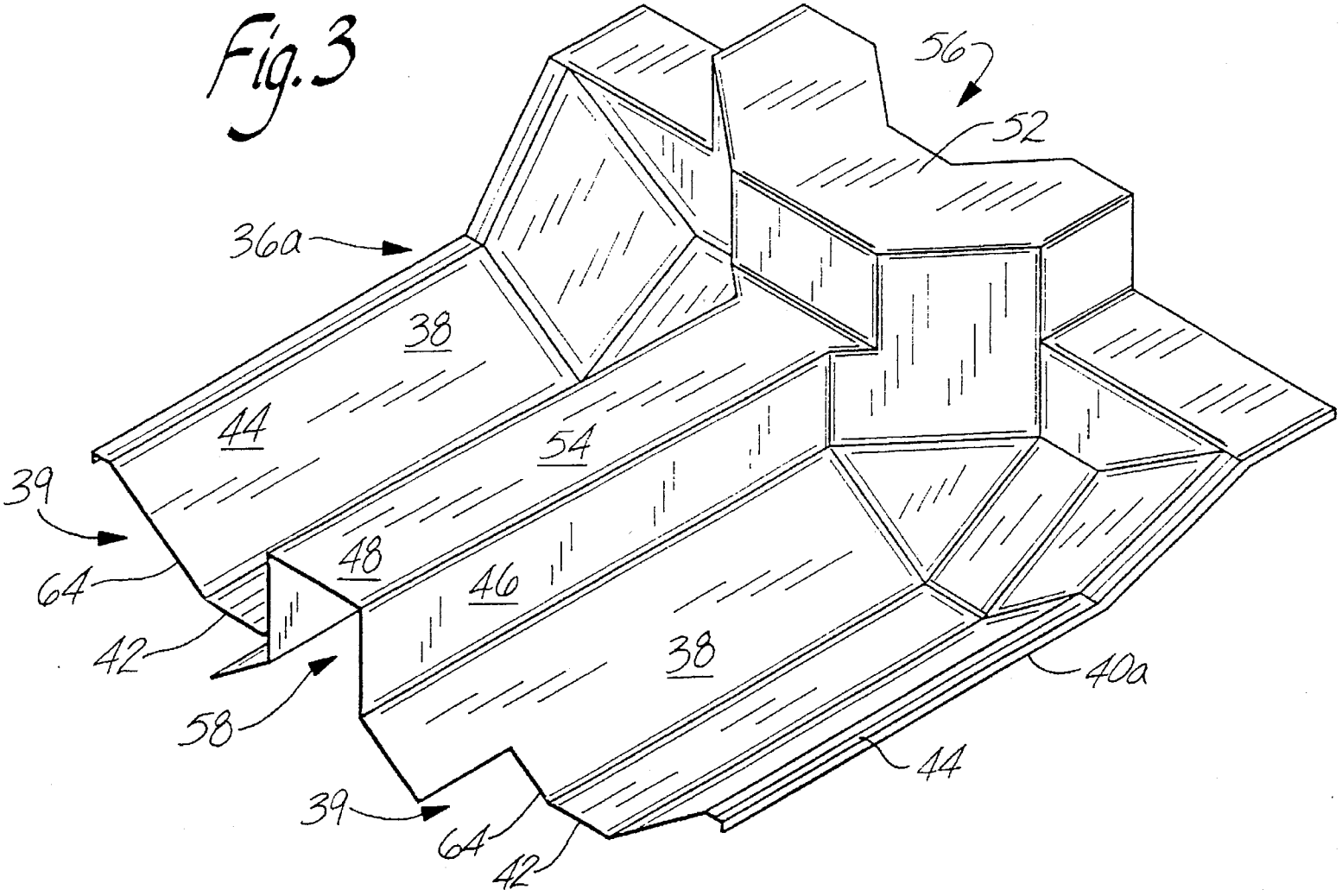
FIG. 3 is a perspective schematic illustration of the mooring of FIGS. 1 and 2.

As shown in FIGS. 1–3, the mooring 36*a* may include a pair of parallel arranged hull segments 42 defining a bi-hull for the mooring 36*a*. Each of the hull segments 42, in cross section transverse to their keels is approximately V-shaped. In a fore-to-aft direction each keel may be somewhat arcuate, as best shown in FIG. 2, commonly known as a rocker bottom. Each of the hull segments 42, moving aft-to-forward tapers and narrows along the arc of the keels to merge into a substantially horizontal, stepped, platform 52. For purposes which will hereinafter become evident, the spaced, upstanding walls 46, in cooperation with a cover 54, define the downwardly open, fore-to-aft extending duct 48, for the mooring 36*a*.

The inboard margins of the hull segments 42 merge to the duct 48. At the platform 52 of the mooring 36*a*, the hull segments 42 and platform 52 define a collector 56 which converges from the forward end of the mooring 36*a* into the duct 48. While open to the water, the volume defined by the collector 56 and the duct 48, is closed from above by the walls 46, cover 54 and platform 52.

As can be appreciated, the wash from the vessel's powerplant, as shown in FIGS. 1–2, the outboard motor 30, is collected by the collector 56 and directed into the duct 48, along the center line of the mooring 36*a*, to exit at duct outlet 58. The wash collecting and directing feature of the mooring 36*a*, and more particularly its collector 56 and duct 48, according to this embodiment of the present invention, has been found to stabilize and maintain the maneuverability of the vessel 12*a* when traveling at higher speeds. Without the feature of the duct 48 for the higher speed pontoon boats, such as the vessel 12*a*, shown in FIGS. 1 and 2, it has been found that the maneuverability and stability of the vessel 12*a* is disadvantageously affected by the mooring 36*a*.

As shown in FIGS. 1–3, the receptacles 38 are generally V-shaped to receive and support the personal watercraft 34 and to accommodate the sliding of the personal watercraft 34 therein. Each of the receptacles 38 has the opening 39, which is proximate the waterline. Between the outer sides 44 and walls 46, each of the receptacles 38 is adapted to provide vertical support for the personal watercraft 34 at least partially out of the water and to confine the watercraft 34 within each of the dedicated receptacles 38.

Each receptacles 38, as best shown in FIG. 3, at the opening 39 may include a rectangular notch 64 adapted to, when a personal watercraft 34 is disposed thereon, position the personal watercraft's impeller intake (not shown) and its outlet to the water. By virtue of the notches 64, when a personal watercraft 34 is secured in its receptacle 38 and supported at least partially out of the water by the mooring 35*a*, the notch 64 provides for the supply of water to the watercrafts 34 intakes so that the personal watercraft 34 may be operated while secured in its receptacle 38.

To couple the mooring 36 to the pontoon vessel 12, a coupling 66*a*, as shown in FIG. 2 is provided. The coupling 66*a* is adapted to secure the mooring 36*a* at the stern of the vessel 12*a* proximate the transom 28. While the coupling 66*a* may be rigid, preferably as shown in FIG. 2 and where the vessel 12*a* is a pontoon boat or higher speed craft of like construction, the coupling 66*a* includes at least a pair of draw bars 68, one end of each of which is pivotally connected to the underside of the deck 20 or at the transom 28 at pivots (not shown) and the other end of each to the mooring 36*a* by pivots 70. In this manner, the mooring 36*a* can, with reference to FIG. 2, pitch relative to the vessel 12*a* to alter the angle which the hull structure 40 makes with the water surface.

To control the pitching of the mooring 36*a*, means for tilting the mooring 36*a* are provided. With reference to FIG. 2, these tilting or pitching means, may be embodied as an extendable and contractible links 72 attached between the hull structure 40, forward of pivots 70, and each of the draw bars 68. The links 72 may be hydraulic cylinder/piston devices, the piston coupled to the underside of platform 52, and the cylinder attached to draw bar 68. Alternatively they could be electro-mechanical devices such as an electrically driven screw device. As can be appreciated, by virtue of the links 72, draw bars 68 and pivots 70, extension and contraction of the links 72 urge the mooring of 36*a* to pitch forward or aft in a controlled fashion, as shown in FIG. 2. In this fashion, while stationary, the links 72 may be actuated to pitch the mooring 36*a* aft, lowering its aft end for slidable nesting of the personal watercraft 34 into its respective receptacle 38. At slow speeds, the links 72 can be actuated to pitch the mooring 36*a* to a neutrally buoyant position. For travel at higher speeds, is to be understood that due to the drag presented by the mooring 36*a*, the vessel 12*a* may tend to pitch aft, raising its bow 18 and affecting not only speed and range, i.e. performance, but maneuverability as well.

To counter the drag effect induced by the mooring 36*a*, the links 72 may be actuated to pitch the mooring 36*a* in a direction counter-clockwise shown in FIG. 2, lowering the aft end of the mooring 36*a* and changing the angle the hull structure 40 makes with the surface of the water and reducing the surface of the mooring 36*a* in the water, reducing drag for more efficient performance.

With reference to FIGS. 2 and 3, it can be appreciated that the walls 46 and cover 54 define the duct 48, which increases in its vertical dimension and cross-sectional area from the collector 56 to the outlet 58. Accordingly, when the links 72 are actuated for higher speed motoring of the vessel 12 to advantageously tilt the mooring 36*a* to reduce drag, the cover 54 will, as a result of pitching of the mooring 36*a*, become substantially parallel to the surface of the water.

Accordingly, tilting of the mooring 36a does not result in reduction of the cross-sectional area of the duct 48 which could impose additional drag on the vessel 12a.

For towage of the system 10 on land with a wheeled trailer, the links 72 are positioned and locked to retain the mooring 36a in at least a horizontal attitude. On the trailer, the mooring 36a thus stows the watercraft 34 as well.

During higher speed travel, it is to be understood that the powerplant, shown as outboard motor 30, will generate a spray and wash behind the vessel 12a, which includes the area occupied by the mooring 36a. It has been found that by providing the collector 56 and duct 48, a portion of this spray and wash generated by the outboard motor 30 are collected, passed through, and discharged at the outlet 58 for the duct 48. This feature, it has been determined, enhances the maneuverability of the system 10. Further, the duct 48 contributes to the reduction of drag by channelling the spray and wash. Absent the collector and duct hereinabove described, it has been found that the system 10 is difficult to maneuver. It is believed that this difficulty heretofore encountered is related to various factors including the location of the hydraulic center of the system 10, as opposed to the vessel 12a itself, the location of the powerplant and steerage, the wash characteristics generated by the powerplant and vessel 12a and the drag imposed by the mooring 36a.

As can be appreciated, by virtue of the mooring 36a, a system 10 is provided which can moor one or more personal watercraft 34 quickly and easily for transportation to locations beyond the range of the personal watercraft. Further, the mooring of 36 of FIGS. 1–3 also, advantageously, can be operated to reduce drag during higher speed motoring of the vessel 12a. Still further, and by virtue of the duct 48 and collector 56, the mooring 36a is configured to maintain the maneuverability of the vessel 12a.

To secure each of the personal watercraft 34 in its respective receptacle 38, suitable ties such as lines, clips or cords are provided. The ties secure the watercraft 34 to the mooring 36a and are attached between the mooring 36a at the platform 52 and each of the watercraft 34.

Figure 4:
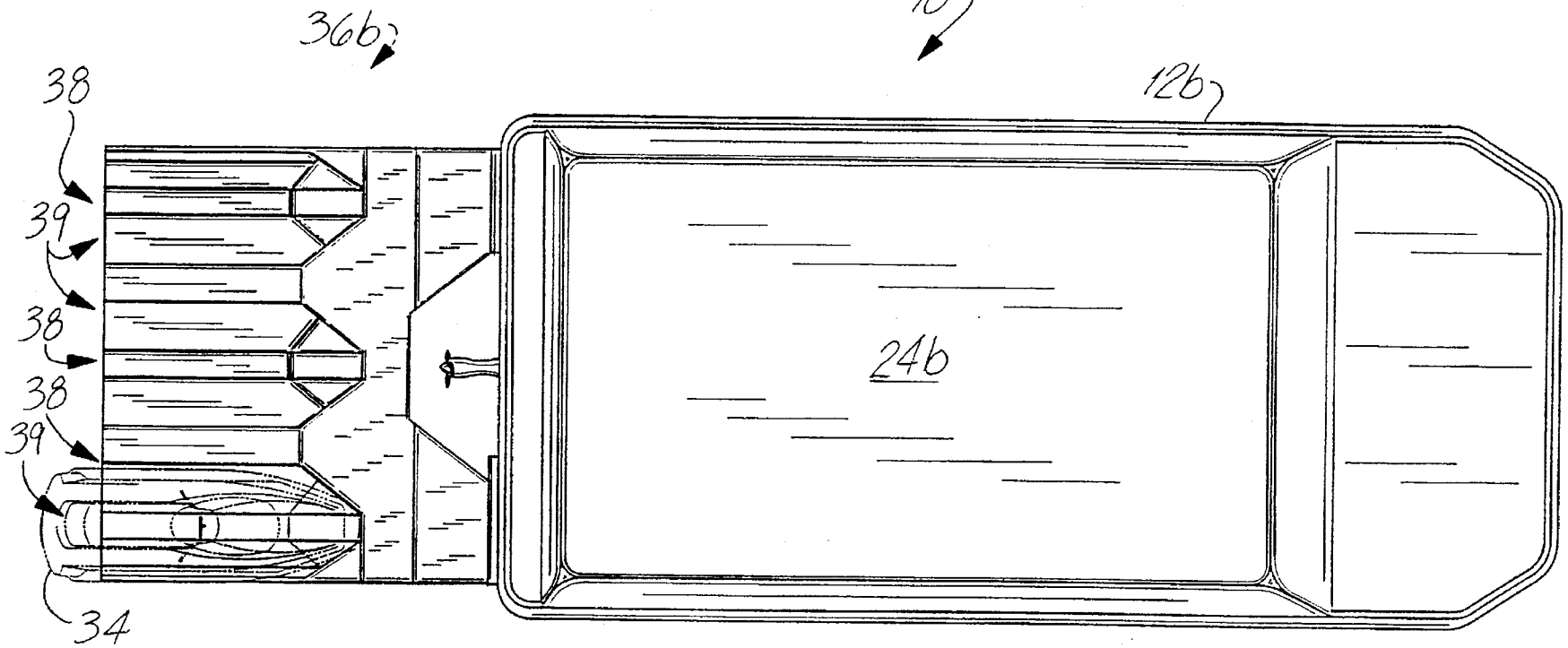
FIG. 4 is a top view of another embodiment of the system, according to the present invention, which includes a houseboat.
Figure 5:
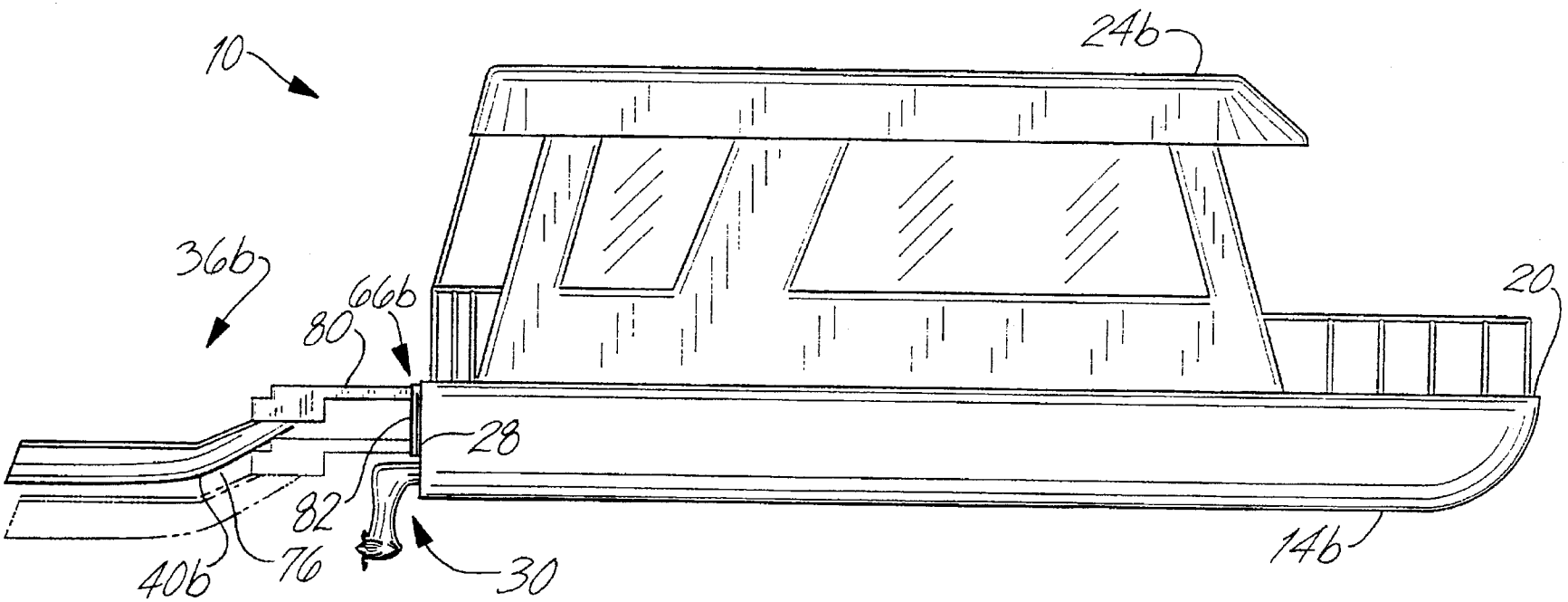
FIG. 5 is a side view of the houseboat and system of FIG. 4.

Turning to FIGS. 4 and 5 another embodiment of the system 10 of the present invention is shown. According to this embodiment, the system 10 includes a vessel 12b embodied as a houseboat. The vessel 12b has a hull 14b which may be aluminum or fiberglass and with a single, bihull, trihull or other suitable configuration known in the art. The hull 14b, also as known, supports a deck 20 and cabin 24b. A powerplant such as an inboard/outboard motor 30 is provided at the transom 28 of the vessel 12b.

To provide for the transportation of one or more personal watercraft 34, the system 10 includes a mooring 36b disposed at the transom 28. The mooring 36b has a hull structure 40b which, as described above, may be fashioned from aluminum, fiberglass or other suitable material. The hull structure 40b is buoyant, to not only buoyantly support itself but one or more watercraft 34. As above, the buoyancy may be obtained through any known technique such as sandwich construction. The hull structure 40b may be relatively flat with an angled nose 76 to divert the water during transportation similar to the bow of a barge. The hull structure 40b may also have a typical keel design with a single hull, bihull or trihull configuration. Because the houseboat vessel 12b is a relatively slow craft, the mooring hull structure 40b according to this embodiment of the invention need not have a configuration for higher speed travel.

The hull structure 40b defines, in cooperation with partitions 78 three receptacles 38, each adapted to receive and accommodate a watercraft 34. Similar to the embodiment described with reference to FIGS. 1–3, each receptacle 38 at the aft terminus of the mooring 36b has an opening 39 proximate the surface of the water to permit the watercraft 34 to be slidably nested from the mater surface into the receptacle 38. At each opening 39 there may also be included a notch (not shown) to expose the intake and exhaust of the watercraft 34 to the water. Suitable ties are provided to tie the watercraft 34 in its receptacle 38.

To attach the mooring 36b to the vessel 12b, a coupling 66b is provided. While the coupling 66b may be ridged, preferably it includes one of more supports 80 attached at one end to the hull structure 40b and at the other end to a vertically displacable mount 82 at the transom 28 for the vessel 12b. As shown in FIG. 5, the supports 80 secure the mooring 36b in a cantilever fashion to the mount 82.

To enable the mooring 36b and any watercraft 34 disposed therein to be raised from and lowered into the water, the mount 82 is adapted to vertically displace the supports 80 and thereby the mooring 36b. Accordingly the mount 82 may include one or more hydraulically actuated cylinders, electro-mechanical devices or a manually operated jack system. In any known fashion the mount 82 has either is driver or driven element secured to the transom 28 and the other operative component coupled to the support 80. For motoring or for launching of the watercraft 34, the mooring 36b, by operation of the mount 82, is lowered into the water. For periods of inactivity such as, for example, when the vessel 12b is anchored at a marina, the mount 82 is operated to raise the mooring 36b and any water craft 34 supported thereon from the water as shown in FIG. 5. In this fashion the watercraft 34 can be stowed out of the water to avoid corrosion and build-up of biologic or chemical deposits on their emersed components.

Figure 6:
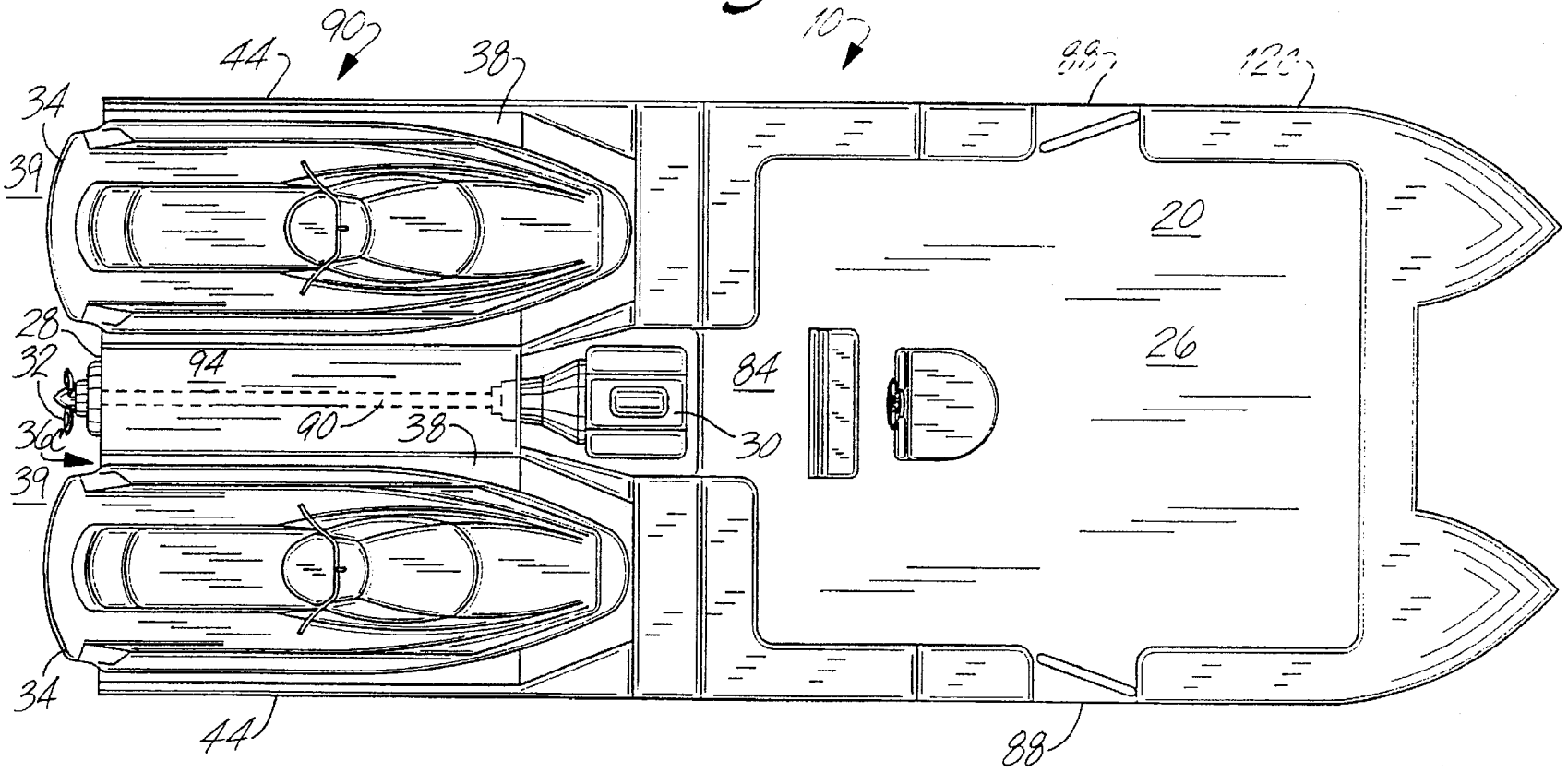
FIG. 6 is a top view of a further embodiment of the system including a platform boat.
Figure 7:
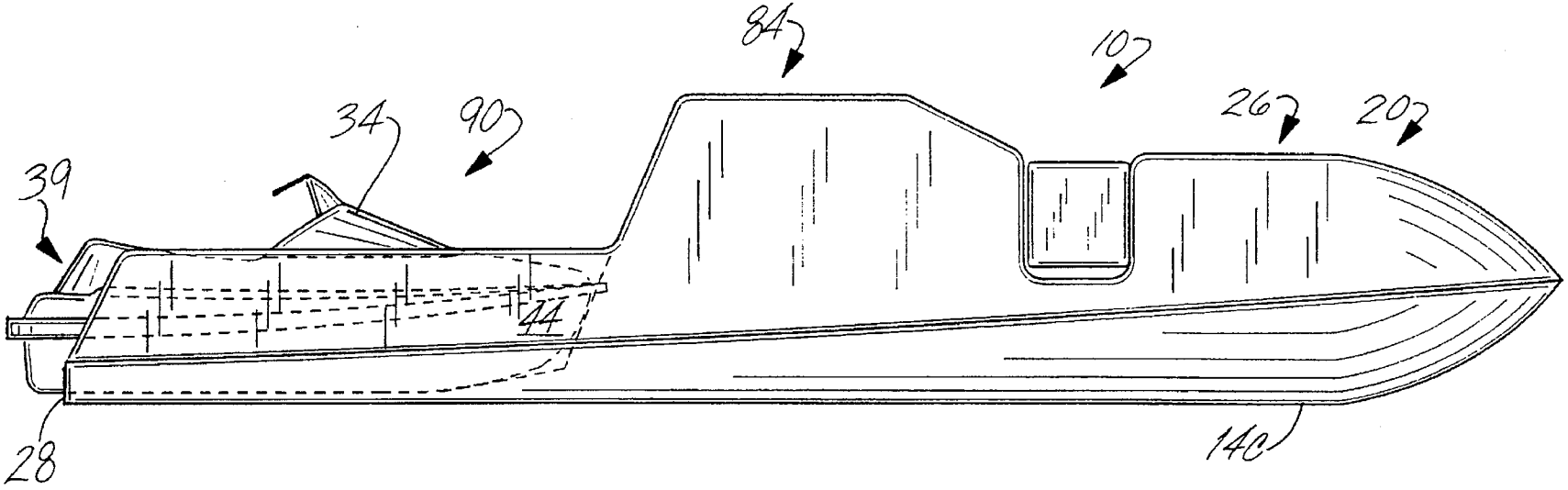
FIG. 7 is a side view of the system of FIG. 6 shown without the powerplant for clarity.

Turning to FIGS. 6 and 7 still another embodiment of the present invention is shown. Like components have like reference numbers. According to this embodiment the system 10 includes a vessel 12c which is illustrated at a deck boat. The deck boat vessel 12c has a hull 14c which typically is fiberglass or other similar construction and may be as a single hull, bihull or trihull design. The vessel 12c illustrated is shown as a bihull. The hull 14c, by its design and construction, in a known fashion, provides buoyancy for the vessel 12c. A deck 20 is provided on the hull 14c and includes a foredeck 26 having, conventionally, seating areas for the passengers. Also provided on the deck 20, shown as being approximately amidship, is a cockpit 84 at with the pilot steers and operates the vessel 12c. Seating 86 may be provided about the cockpit 84 for passengers. Doors 88 at the sides of the vessel 12c provide access to the deck 20 and, in particular, the foredeck 26.

To drive the vessel 12c a powerplant is provided which is typically an inboard/outboard motor 30. The motor 30 drives a shaft 90 which terminates outboard of the transom 28 at a propeller 32. By virtue of the configuration of the hull 14c and the output of the motor 30, the vessel 12c, when embodied as a deck boat, can obtain speeds in excess of most pontoon boats and sufficient to accommodate waterskiers.

Due to the buoyancy provided by the hull 14c, the vessel 12c presents an aft deck 90 at the transom 28 thereof which is proximate the surface of the water. This has proven advantageous to permit skiers egress from and ingress to the vessel 12c.

To provide for the transportation on one or more personal watercraft 34, a mooring 36c is defined at the vessel's transom 28. As shown, the mooring 36*c* according to this embodiment of the invention includes a pair of receptacles 38 fashioned at the transom 28 and extending onto the aft deck 92. Each receptacle 38, where the hull 14*c* is fashioned from fiberglass, is formed therewith. The receptacles, as illustrated, are defined by the sides 44 of the vessel 12*c* at the aft deck 92 and a housing 94 which extends fore-to-aft at the aft deck 92 to accommodate the propeller shaft 90. The housing 94 is closed and may be fashioned from fiberglass or any other suitable material when the hull 14*c* is formed.

Each receptacle 38, as described above, has an opening 39 proximate the water surface to permit the watercraft 34 to be slidably received from the waters surface into a receptacle 38 in the manner described above. Suitable ties are then used to secure the watercraft in its receptacle.

As can be appreciated, to transport the watercraft 34, it is urged from the water into its receptacle and tied. Thereafter, the vessel 12*c* is piloted, under power of its motor 30, to the desired location. The range of the vessel 12*c* permits the watercraft 34 to be transported to remote locations which the watercraft 34 could not otherwise, from a practical standpoint, travel to under its own power. At the desired location, the watercraft 34 is untied an pushed into the water for operation.

Considering the embodiments shown and described with reference to FIGS. 1–5, the watercraft 34 may also be used for steerage at slow speeds. For example, the pilot of the vessel 12*a,b* may desire to dock the vessel 12*a,b* at a location in which it is difficult to maneuver. He/she may be required to position the vessel 12*a,b* between other vessels or obstructions. On these occasions, and by virtue of the mooring 36*a,b* which includes the notch 64, the watercraft 34, while still moored and tied in its receptacle 38 may be started. The pilot would then, by steering the personal watercraft's water jet, either with or without operation of the vessel's motor 30, urge the vessel system 10 to the desired location.

It is to be further appreciated that the moorings 36*a,b,c* described and depicted herein provide a convenient stowage for the watercraft 34 when they are not is use. Still further, where the vessel 12*a,b,c* is to be transported on a trailer, the system 10 can also be used to accommodate the watercraft 34 on the same trailer. In this manner the vessel 12*a,b,c* and watercraft 34 can be hauled together to the launch. Separate towing of the watercraft 34 by separate vehicles, heretofore required, is unnecessary.

Further, the location of the moorings 36*a,b,* for houseboats and pontoon boats, keeps persons clear of the propeller 32.

It should also be appreciated that the system 10 also provides for launch of both the watercraft 34 and vessel 12*a,b,c*. Prior systems required at least several persons to launch the vessel 12*a,b,c* into the water and to separately launch each of the watercraft 34. By virtue of the system 10 herein described, the vessel 12*a,b,c* and its watercraft 34 can be launched into the water as a unit. This dispenses with the need for separate launches and the several persons necessary for that purpose.

While I have shown and described certain embodiments of my invention, it is to be understood that it is subject to modification without departing from the spirit and scope of the claims. For example, the mooring 36*a,b,c* may be configured to receive a single watercraft 34 with the remainder adapted to act as storage for fuel and equipment.

I claim:

1. A vessel and personal watercraft system comprising:

(i) a vessel including a powerplant for driving the vessel in the water;

(ii) at least one personal watercraft;

(iii) a mooring defined at the transom of the vessel to receive and moor the personal watercraft for transportation by the vessel, the mooring including, (a) at least one receptacle proximate the water's surface to slidably nest the personal watercraft from the water's surface into a moored position, the receptacle having a configuration to mate with the personal watercraft and defining a support surface to support the personal watercraft at least partially out of the water for transportation with the vessel under power of the powerplant when moored in the receptacle; and (b) means to secure the personal watercraft to the vessel in the moored position for transportation therewith.

2. The system of claim 1 wherein the mooring is attached to the vessel at the transom of the vessel and further includes;

(i) a hull structure to buoyantly support the mooring;

(ii) at least one receptacle defined on the hull structure to slidably nest the personal watercraft from the water's surface into a moored position where the personal watercraft is at least partially out of the water and supported by the hull structure;

(iii) a coupling to secure the mooring to the vessel in a towed relationship.

3. The system of claim 2 wherein the hull structure includes;

(i) first and second hull segments having substantially parallel keels;

(ii) a downwardly open passage defined between the first and second hulls and aligned with the keels, said passage adapted to direct water passing therethrough in a direction aft of the mooring.

4. The system of claim 3 wherein the hull segments each have a V-shaped cross-section.

5. The system of claim 4, wherein the hull segments cooperate to define a converging collector which communicates with the duct to collect and direct wash created by the vessel to the duct.

6. The system of claim 2 wherein the coupling includes means for tilting the mooring hull structure relative to the surface of the water to reduce drag.

7. The system of claim 6 wherein the coupling includes at least one drawbar pivotably coupled to the mooring and the vessel and at least one extendible member disposed between the drawbar and mooring, extension of the member tilting the mooring hulls relative to the water to reduce drag for the vessel.

8. The system of claim 6 wherein the hull structure includes;

(i) first and second hull segments having substantially parallel keels;

(ii) a downwardly open passage defined between the first and second hulls and aligned with the keels, said passage adapted to receive direct water in a direction aft of the mooring.

9. The system of claim 8 wherein the passage is defined by walls upstanding from the hull and a cover.

10. The system of claim 9 wherein the cover is adapted to be substantially parallel to the surface of the water when the mooring is tilted aft to reduce drag.

11. A personal watercraft mooring adapted to be coupled to a vessel for transportation therewith, the mooring comprising;

(i) a mooring hull structure to buoyantly support the mooring in the water;

(ii) at least one receptacle defined on the hull structure to slidably nest the personal watercraft from the water's surface into a moored position whereat the personal watercraft is at least partially out of the water and supported by the hull structure;

(iii) a coupling to secure the mooring to the vessel in a towed relationship.

12. The mooring of claim 11 wherein the hull structure includes;

(i) first and second hull segments having substantially parallel keels;

(ii) a downwardly open passage defined between the first and second hulls and aligned with the keels, said passage adapted to direct water in a direction aft of the mooring.

13. The mooring of claim 12 further includes means for tilting the hulls relative to the surface of the water to reduce drag.

14. The mooring of claim 12 wherein the passage is defined by walls upstanding from the hull and a cover.

15. The mooring of claim 14 wherein the coupling includes at least one hydraulically driven piston and cylinder device.

16. A mooring for at least one personal watercraft comprising:

(i) a buoyant hull structure;

(ii) at least one receptacle defined on the hull structure to slidably nest the personal watercraft from the water's surface into a moored position whereas the personal watercraft is at least partially out of the water and supported by the buoyant hull structure;

(iii) a coupling to attach the hull structure to a powered vessel in a towed relationship; and (iv) means for tilting the hull structure relative to the surface of the water to reduce drag.

17. A mooring for at least one personal watercraft adapted to be connected to the transom of a powered vessel comprising:

(i) a hull structure;

(ii) at least one receptacle defined on the hull structure adapted to slidably nest the personal watercraft from the water into a moored position whereas the personal watercraft is at least partially out of the water and supported by the hull structure;

(iii) means for securing the watercraft to the mooring in the moored position; and (iv) a coupling to attach the hull structure to the vessel proximate the transom, said coupling including means for displacing the mooring vertically relative to the water to raise and lower the hull structure and any watercraft supported thereon from and to the water.

18. The mooring of claim 17 wherein the watercraft is of the impeller-jet type having an intake and an exhaust, the mooring further including a notch to submerse the watercraft intake and exhaust when the watercraft is in the moored position for operation of the watercraft jet.

19. A mooring for at least one personal watercraft adapted for use with a powered vessel comprising:

(i) a buoyant hull structure;

(ii) at least one receptacle defined on the hull structure adapted to slidably receive a personal watercraft from the water to a secured, moored position whereas the personal watercraft is at least partially supported out of the water by the hull structure;

(iii) a duct defined on the hull structure to direct a portion of the wash from the vessel fore-to-aft; and (iv) a coupling to secure the mooring proximate the transom of the vessel, the coupling including means to tilt the hull structure relative to the water to reduce drag.

20. A personal watercraft transportation system comprising;

(i) a motor powered vessel having a hull and a substantially continuous deck which terminates at a transom;

(ii) at least one receptacle defined on the vessel to present an opening at the water's surface at the transom, said receptacle and opening adapted to slidably receive a personal watercraft urged from the water onto said deck into a moored position, the deck supporting the watercraft in the moored position substantially out of the water during transportation with the vessel; and (iii) means for securing the watercraft to the vessel in the moored position.

21. The system of claim 20 wherein the vessel includes an upstanding, fore-to-aft extending housing on the deck which terminates proximate the transom and vessel sides, a pair of receptacles defined at the transom by the housing and sides, each of said receptacles presenting an opening at the water's surface, and each adapted to slidably receive a watercraft to said moored position.

22. The system of claim 21 wherein said powered vessel includes a power plant disposed substantially amidship, a propeller shaft drivably coupled at one end to the power plant and at the other end mounting a propeller, said housing accommodating said shaft.

23. The system of claim 20 wherein each personal watercraft has a shaped bottom, the deck at each receptacle shaped to mate with and nest the bottom of each watercraft.

* * * * *